US011011083B2

(12) United States Patent
Kim et al.

(10) Patent No.: US 11,011,083 B2
(45) Date of Patent: May 18, 2021

(54) DISPLAY DEVICE

(71) Applicant: SAMSUNG DISPLAY CO., LTD., Yongin-si (KR)

(72) Inventors: Wontae Kim, Hwaseong-si (KR); Hae-Kwan Seo, Hwaseong-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/835,518

(22) Filed: Mar. 31, 2020

(65) Prior Publication Data

US 2020/0320908 A1 Oct. 8, 2020

(30) Foreign Application Priority Data

Apr. 3, 2019 (KR) ..... 10-2019-0038902

(51) Int. Cl.

| | |
|---|---|
| ***G09G 5/00*** | (2006.01) |
| ***G09F 9/30*** | (2006.01) |
| ***G09G 3/3275*** | (2016.01) |
| ***G09G 3/3225*** | (2016.01) |

(52) U.S. Cl.

CPC ..... *G09F 9/301* (2013.01); *G09G 3/3225* (2013.01); *G09G 3/3275* (2013.01); *G09G 2380/02* (2013.01)

(58) Field of Classification Search

CPC ..... G09G 3/3225; G09G 3/3275; G09G 9/30; G09G 9/31; G09G 2380/02; G06F 1/1652

See application file for complete search history.

(56) References Cited

U.S. PATENT DOCUMENTS

| | | | | |
|---|---|---|---|---|
| 9,419,065 | B2 * | 8/2016 | Degner | H01L 27/326 |
| 10,249,256 | B2 * | 4/2019 | Park | G09G 3/3688 |
| 10,642,313 | B1 * | 5/2020 | Wu | G06K 9/0002 |
| 2011/0261031 | A1 * | 10/2011 | Muto | G09G 3/344 345/204 |
| 2018/0089485 | A1 * | 3/2018 | Bok | G06F 1/1684 |
| 2018/0130421 | A1 * | 5/2018 | Zhou | G09G 3/3266 |
| 2018/0374440 | A1 * | 12/2018 | Chen | H01L 27/1214 |
| 2020/0105062 | A1 * | 4/2020 | Shi | G06T 19/006 |
| 2020/0211469 | A1 * | 7/2020 | Jeon | G09G 3/3275 |

FOREIGN PATENT DOCUMENTS

| | | |
|---|---|---|
| JP | 5754782 | 7/2015 |
| KR | 10-2015-0136669 | 12/2015 |
| KR | 1020150136669 | * 12/2015 |

* cited by examiner

*Primary Examiner* — Joe H Cheng

(74) *Attorney, Agent, or Firm* — F. Chau & Associates, LLC

(57) ABSTRACT

A display device includes: a display panel including a first display region, a second display region, and a third display region between the first display region and the second display region; and a display panel driving circuit configured to drive the display panel, wherein the display panel driving circuit drives the first display region, the second display region, and the third display region in a full pixel-row driving manner when an image is displayed on the first display region, the second display region, and the third display region, and wherein the display panel driving circuit drives the first display region in the full pixel-row driving manner and drives the third display region in a partial pixel-row driving manner when the image is displayed only on the first display region and the third display region.

20 Claims, 10 Drawing Sheets

DISPLAY DEVICE

CROSS-REFERENCE TO RELATED APPLICATION(S)

This application claims priority under 35 USC § 119 to Korean Patent Application No. 10-2019-0038902, filed on Apr. 3, 2019 in the Korean Intellectual Property Office (KIPO), the disclosure of which is incorporated by reference herein in its entirety.

TECHNICAL FIELD

Exemplary embodiments of the present invention relate to a display device. More particularly, exemplary embodiments of the present invention relate to a display device including a display panel that can fold or perform a sliding or rolling operation.

DISCUSSION OF THE RELATED ART

Recently, an interest in a display device including a foldable display panel that can fold or a display panel that can perform a sliding operation has been increasing. For example, an image may be displayed on only a portion of a display region of the foldable display panel when the foldable display panel is in a folded state, and an image may be displayed on an entire display region of the foldable display panel when the foldable display panel is in an unfolded state. For example, an image may be displayed on a portion of a display region or an entire display region of the slidable display panel, which is pulled out from a housing. In the foldable display panel or the slidable display panel, an operating time of the portion of the display region (e.g., a front display region of the foldable display panel, an exposed display region of the slidable display panel, etc) may be relatively long. Thus, with time, a degree of deterioration of the display region of which the operating time is relatively long may become different from (e.g., greater than) a degree of deterioration of a display region of which the operating time is relatively short. As a result, a boundary line due to a deterioration difference between the display region of which the operating time is relatively long and the display region of which the operating time is relatively short may be displayed while an image is displayed on an entire display region of the foldable display panel or the slidable display panel. Thus, a user (or, for example, a viewer) may perceive a luminance difference (or, for example, an image quality difference) due to the deterioration difference between the display region of which the operating time is relatively long and the display region of which the operating time is relatively short.

SUMMARY

According to an exemplary embodiment of the present invention, a display device includes: a display panel including a first display region, a second display region, and a third display region disposed between the first display region and the second display region; and a display panel driving circuit configured to drive the display panel, wherein the display panel driving circuit drives the first display region, the second display region, and the third display region in a full pixel-row driving manner when an image is displayed on the first display region, the second display region, and the third display region, wherein in the full pixel-row driving manner, all pixel-rows perform a display operation in each frame, and wherein the display panel driving circuit drives the first display region in the full pixel-row driving manner and drives the third display region in a partial pixel-row driving manner when the image is displayed only on the first display region and the third display region, wherein in the partial pixel-row driving manner, some pixel-rows that are selected differently in each frame perform the display operation.

In an exemplary embodiment of the present invention, the display device is a foldable display device, wherein the first display region is a region of the display panel that corresponds to a front side of the display device when the display panel is folded, wherein the second display region is a region of the display panel that corresponds to a back side of the display device when the display panel is folded, and wherein the third display region connects the first display region to the second display region.

In an exemplary embodiment of the present invention, the display panel driving circuit displays an image only on the first display region and the third display region when the display panel is folded.

In an exemplary embodiment of the present invention, the display device is a reliable display device, wherein the first display region is a region of the display panel that is pulled out from a housing and spaced apart from the housing by at least a reference distance, wherein the second display region is a region of the display panel that is disposed in the housing, and wherein the third display region is a region of the display panel that is pulled out from the housing and spaced apart from the housing by a distance less than the reference distance.

In an exemplary embodiment of the present invention, the display panel driving circuit displays an image only on the first display region and the third display region.

In an exemplary embodiment of the present invention, an area of the third display region is based on the reference distance.

In an exemplary embodiment of the present invention, the display panel driving circuit performs a data applying operation on selected pixel-rows of the third display region and performs a charge sharing operation on unselected pixel-rows of the third display region when the display panel driving circuit drives the third display region in the partial pixel-row driving manner.

In an exemplary embodiment of the present invention, adjacent frames have afferent selected pixel-rows of the third display region.

In an exemplary embodiment of the present invention, the selected pixel-rows of the third display region are discretely selected in units of one pixel-row.

In an exemplary embodiment of the present invention, the selected pixel-rows of the third display region are discretely selected in units of at least two pixel-rows.

In an exemplary embodiment of the present invention, the display panel driving circuit drives an entire region of the third display region at the same refresh rate when the display panel driving circuit drives the third display region in the partial pixel-row driving manner.

In an exemplary embodiment of the present invention, the display panel driving circuit divides the third display region into first through (j)th sub-display regions, where j is an integer greater than or equal to 2, and drives the first through (j)th sub-display regions at respective refresh rates that are different from each other when the display panel driving circuit drives the third display region in the partial pixel-row driving manner.

In an exemplary embodiment of the present invention, the display panel driving circuit decreases the refresh rates, of the third display region, in a direction from the first sub-display region that is adjacent to the first display region to the (j)th sub-display region that is adjacent to the second display region.

In an exemplary embodiment of the present invention, the display panel driving circuit performs a data applying operation on selected pixel-rows of the third display region and does not perform the data applying operation on unselected pixel-rows of the third display region when the display panel driving circuit drives the third display region in the partial pixel-row driving manner.

In an exemplary embodiment of the present invention, adjacent frames have afferent selected pixel-rows of the third display region.

in an exemplary embodiment of the present invention, the selected pixel-rows of the third display region are discretely selected in units of one pixel-row.

In an exemplary embodiment of the present invention, the selected pixel-rows of the third display region are discretely selected in units of at least two pixel-rows.

In an exemplary embodiment of the present invention, the display panel driving circuit drives an entire region of the third display region at the same refresh rate when the display panel driving circuit drives the third display region in the partial pixel-row driving manner.

In an exemplary embodiment of the present invention, the display panel driving circuit divides the third display region into first through (j)th sub-display regions, where j is an integer greater than or equal to 2, and drives the first through (j)th sub-display regions at respective refresh rates that are different from each other when the display panel driving circuit drives the third display region in the partial pixel-row driving manner.

In an exemplary embodiment of the present invention, the display panel driving circuit decreases the refresh rates, of the third display region, in a direction from the first sub-display region that is adjacent to the first display region to the (j)th sub-display region that is adjacent to the second display region.

BRIEF DESCRIPTION OF THE DRAWINGS

The above and other features of the present inventive concept will become more apparent by describing in detail exemplary embodiments thereof, with reference to the accompanying drawings, in which.

DETAILED DESCRIPTION OF THE EMBODIMENTS

Hereinafter, exemplary embodiments of the present invention will be explained in detail with reference to the accompanying drawings.

Figure 1:
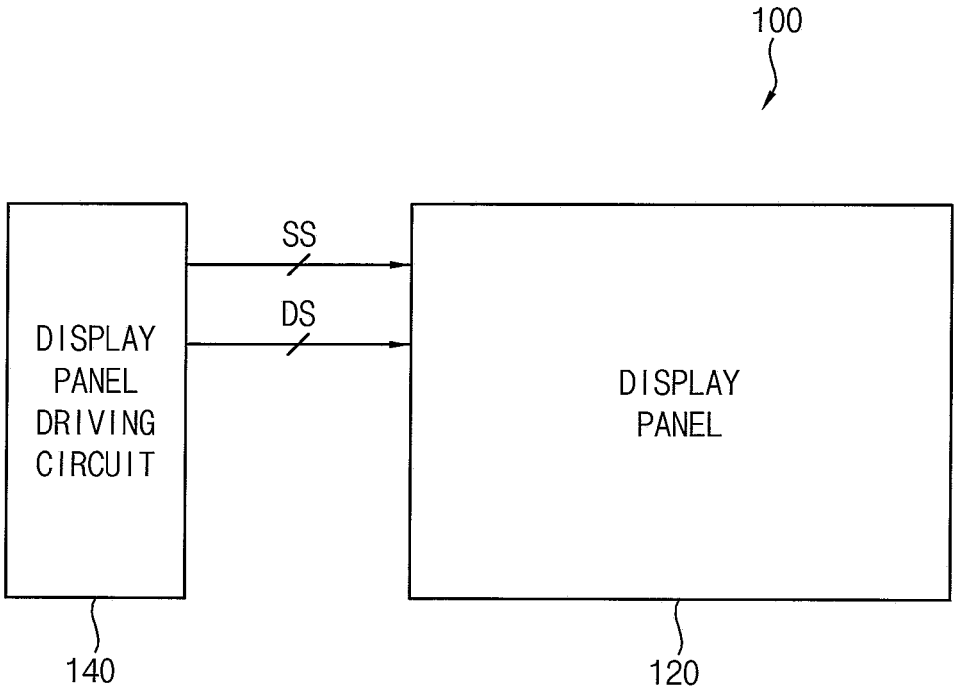
FIG. 1 is a block diagram illustrating a display device according to exemplary embodiment of the present invention.
Figure 2:
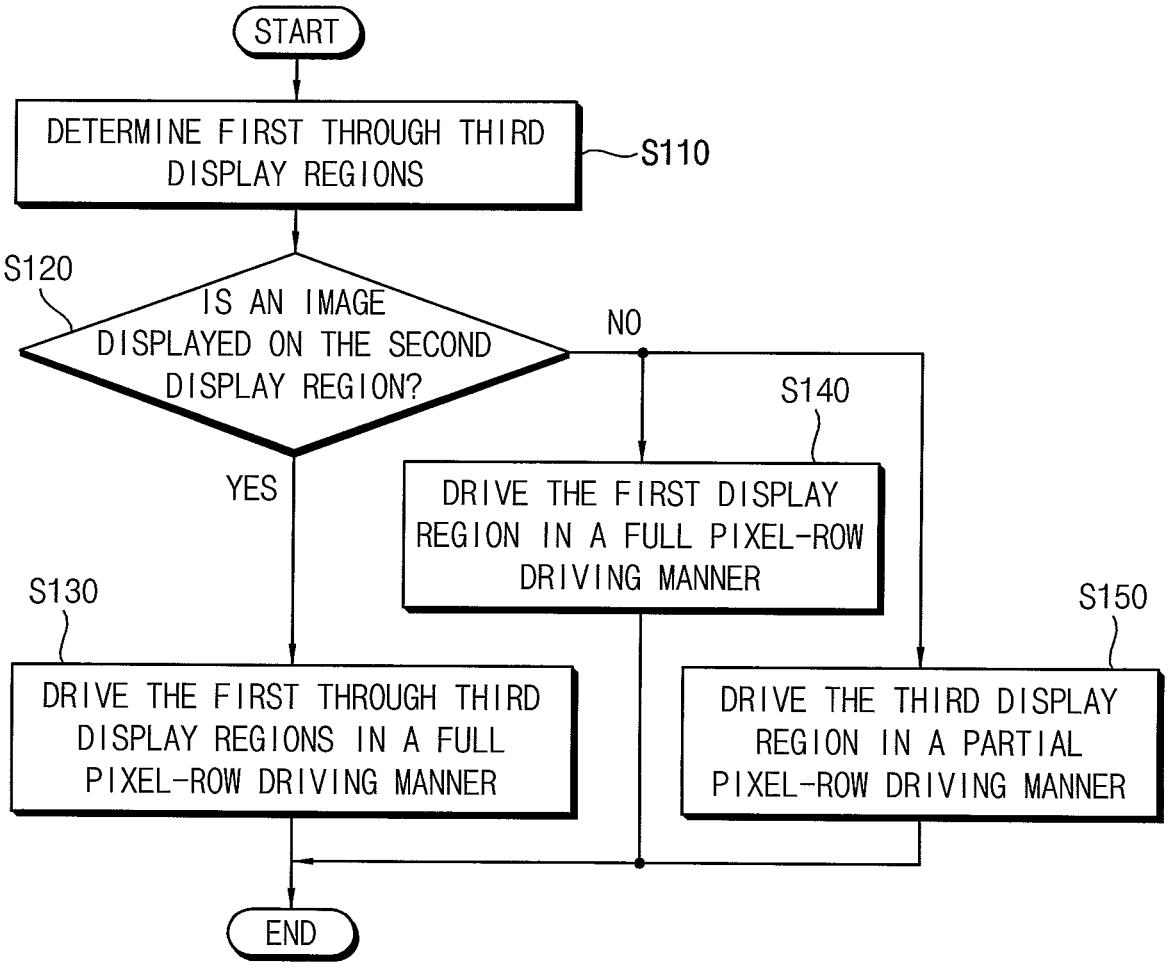
FIG. 2 is a flowchart illustrating an example in which a display panel driving circuit included in the display device of FIG. 1 drives a display panel.
Figure 3:
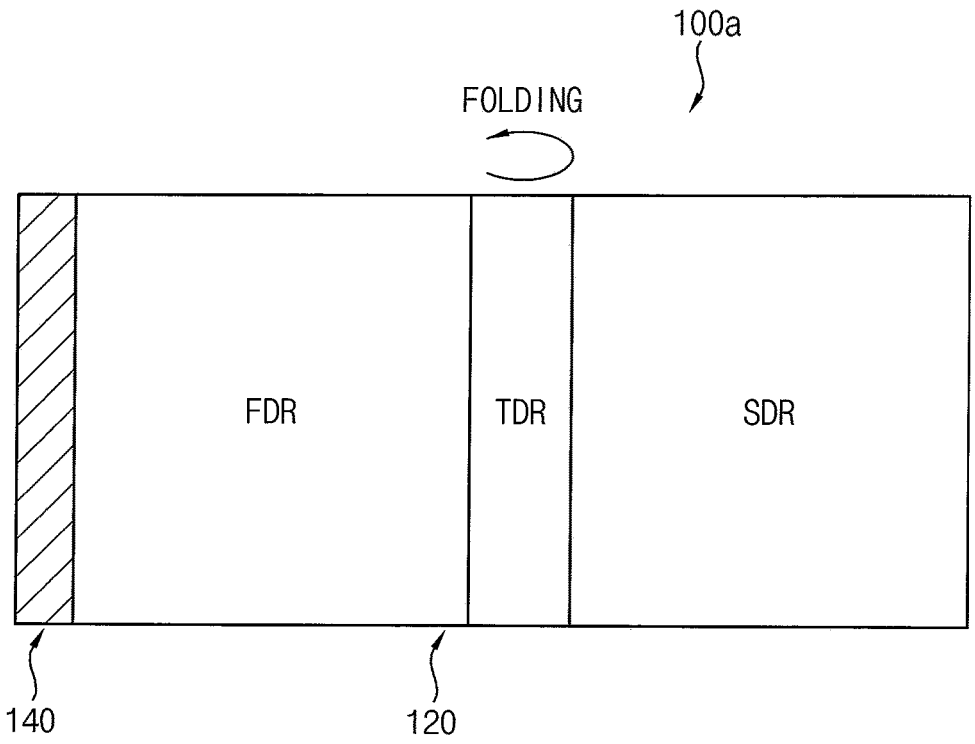
FIG. 3 is a diagram illustrating an example in which the display device of FIG. 1 includes a foldable display panel.
Figure 4:
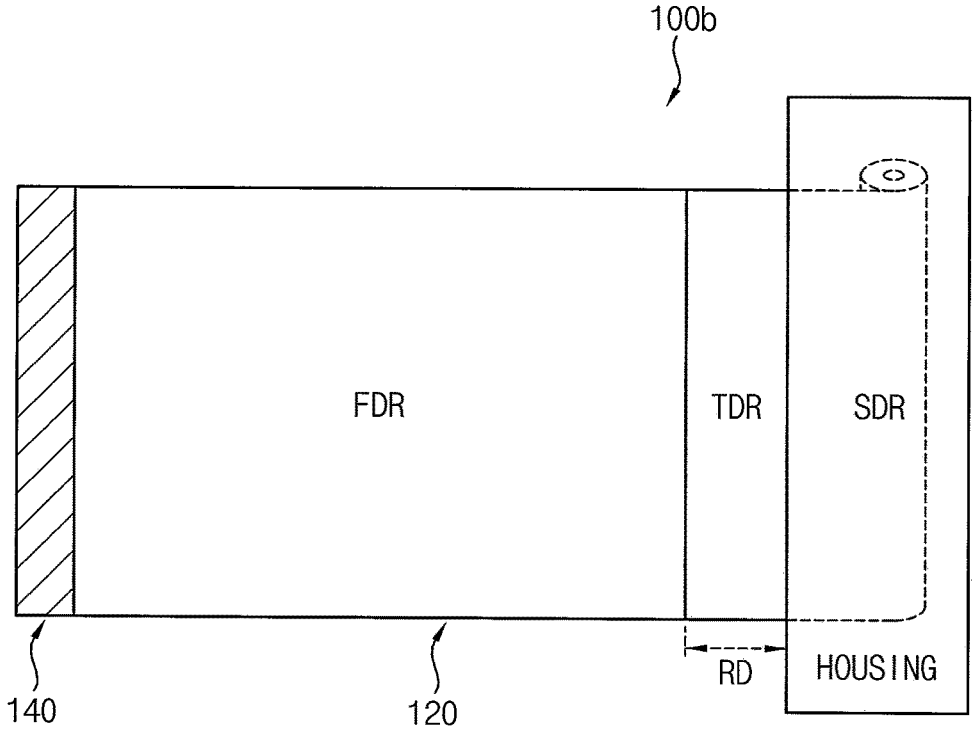
FIG. 4 is a diagram illustrating an example in which the display device of FIG. 1 includes a slidable display panel.

FIG. 1 is a block diagram illustrating a display device according to exemplary embodiment of the present invention. FIG. 2 is a flowchart illustrating an example in which a display panel driving circuit included in the display device of FIG. 1 drives a display panel. FIG. 3 is a diagram illustrating an example in which the display device of FIG. 1 includes a foldable display panel. FIG. 4 is a diagram illustrating an example in which the display device of FIG. 1 includes a slidable display panel.

Referring to FIGS. 1 to 4, the display device 100 ma include a display panel 120 and a display panel driving circuit 140. In an exemplary embodiment of the present invention, the display device 100 may be an organic light-emitting display device. However, the present invention is not limited thereto.

The display panel 120 may include a first display region FDR a second display region SDR, and a third display region TDR that is disposed between the first display region FDR and the second display region SDR. In addition, the display panel 120 (e.g., each of the first display region FDR, the second display region SDR, and the third display region TDR) may include a plurality of pixels. The display panel driving circuit 140 may drive the display panel 120. For example, the display panel driving circuit 140 may include a scan driver, a data driver, and a tuning controller. In an exemplary embodiment of the present invention, the display panel driving circuit 140 may further include an emission control driver when the display device 100 is an organic light-emitting display device. The display panel 120 may be electrically connected to the data driver via a plurality of data-lines, and may be electrically connected to the scan driver via a plurality of scan-lines. In addition, the display panel 120 may be electrically connected to the emission control driver via a plurality of emission control-lines. The data driver may provide a data signal DS to the display panel 120 via the data-lines. For example, the data driver may provide the data signal DS to the pixels via the data-lines. As an additional example, the pixels that simultaneously receive the data signal DS provided by the data driver may be referred to as one pixel-row. The scan driver may provide a scan signal SS to the display panel 120 via the scan-lines.

For example, the scan driver may provide the scan signal SS to the pixels via the scan-lines. As an additional example, the pixels that simultaneously receive the scan signal SS provided by the scan driver may be referred to as one pixel-row. For example, while the scan driver applies the scan signal SS to one pixel-row, the data driver may apply the data signal DS to the pixel-row, and thus, the pixels included in the pixel-row may simultaneously emit light. The emission control driver may provide the emission control signal to the display panel 120 via the emission control-lines. For example, the emission control driver may provide the emission control signal to the pixels via the emission control-lines. The timing controller may control the scan driver, the data driver, and the emission control driver by generating a plurality of control signals and by providing the control signals to the scan driver, the data driver, and the emission control driver. In an exemplary embodiment of the present invention, the timing controller may receive image data and may perform a specific data processing (e.g., deterioration compensation, etc) on the image data to provide the processed image data to the data driver.

In an exemplary embodiment of the present invention, as illustrated in FIG. 3, the display device 100 may be a foldable display device 100*a*. For example, the first display region FDR of the display panel 120 may be a region of the display panel 120 that corresponds to a front side of the display device 100 when the display panel 120 is folded (e.g., indicated by FOLDING), and the second display region SDR of the display panel 120 may be a region of the display panel 120 that corresponds to a back side of the display device 100 when the display panel 120 is folded. In addition, the third display region TDR of the display panel 120 may be a region of the display panel 120 that corresponds to a seam side of the display device 100 when the display panel 120 is folded. For example, the second display region SDR folds towards a back of the first display region FDR, and the third display region TDR connects the first display region FDR to the second display region SDR. In other words, the first display region FDR and the second display region SDR may be connected via the third display region TDR. For example, when the display panel 120 is unfolded, all of the first display region FDR, the second display region SDR, and the third display region TDR may be disposed at a front side of the display device 100, and thus, the display panel driving circuit 140 may display an image on the first display region FDR, the second display region SDR, and the third display region TDR of the display panel 120. In addition, when the display panel 120 is folded, the first display region FDR may be disposed at a front side of the display device 100, the second display region SDR may be disposed at a back side of the display device 100, and the third display region TDR may be disposed as a seam side of the display device 100. Thus, the display panel driving circuit 140 may display an image only on the first display, region FDR and the third display region TDR of the display panel 120 on which a viewer (or, for example, user) can watch the image. In an exemplary embodiment of the present invention, the display panel 120 may have a folding reference line where the display panel 120 is configured to fold and unfold, and when a folding reference line of the display panel 120 is fixed, the first display region FDR, the second display region SDR, and the third display region TDR of the display panel 120 may be fixed regions.

In an exemplary embodiment of the present invention, as illustrated in FIG. 4, the display device 100 may be a slidable display device 100*b* (or, for example, a rollable display device). In this case, the first display region FDR of the display panel 140 may be a region of the display panel 120 that is pulled out from a housing (e.g., indicated by HOUSING) and may be spaced apart from the housing by at least a reference distance RD. In addition, the second display region SDR of the display panel 120 may be a region of the display panel 120 that is not pulled out from the housing (e.g., the second display region SDR is disposed within the housing), and the third display region TDR of the display panel 120 may be a region of the display panel 120 that is pulled out from the housing and spaced apart from the housing by less than the reference distance RD. For example, the first display region FDR and the third display region TDR may be unrolled from a roller, which is provided in the housing, to be in an unrolled configuration, and while the first and third display regions are in the unrolled configuration, the second display region SDR may be rolled around the roller to be in a rolled configuration. As an additional example, a side of the third display region TDR may be adjacent to the housing. In other words, the first display region FDR and the second display region SDR may be connected to each other via the third display region TDR.

For example, when an entire region of the display panel 120 is pulled out from the housing, the display panel 120 may include the first display region FDR, the second display region SDR, and the third display region TDR, and thus the display panel driving circuit 140 may display an image on the first display region FDR, the second display region SDR, and the third display region TDR of the display panel 120. For example, the first, second and third display regions FDR, SDR and TDR may be in an unrolled configuration. In addition, when a portion of the display panel 120 is pulled out from the housing, the display panel 120 may include the first display region FDR, the second display region SDR, and the third display region TDR, but the display panel driving circuit 140 may display an image only on the first display region FOR and the third display region TDR of the display panel 120 on which a viewer can watch or view the image. In other words, when the display device 100 is the slidable display device 100*b*, the first display region TDR, the second display region SDR, and the third display region TDR of the display panel 120 may generate an image according to a pulling state, and the display panel driving circuit 140 may display the image only on the first display region FOR and the third display region TDR of the display panel 120. In an exemplary embodiment of the present invention, the display panel driving circuit 140 may change an area of the third display region TDR by changing the reference distance RD. For example, a width of the third display region TDR may correspond to the reference distance RD. In an exemplary embodiment of the present invention, the display panel driving circuit 140 may change an area of the first display region FDR by changing the reference distance RD.

As described above, according to an, operating state (e.g., the folding state or the pulling (or, for example, sliding or rolling) state) of the display panel 120, the display panel driving circuit 140 may display the image on all of the first display region FDR, the second display region SDR, and the third display region TDR of the display panel 120 or may display the image only on the first display region FDR and the third display region TDR of the display panel 120. For example, when the display panel driving circuit 140 displays the image on the first display region FDR, the second display region SDR, and the third display region TDR of the display panel 120, the display panel driving circuit 140 may drive the first display region FDR, the second display region SDR, and the third display region TDR of the display panel 120 in a full pixel-row driving manner, by which all pixel-rows may perform a display operation in each frame. For example, when the display panel driving circuit 140 drives the first display region FDR, the second display region SDR, and the third display region TDR of the display panel 120 to display an image, the display panel driving circuit 140 may equally drive the first display region FDR, the second display region SDR, and the third display region TDR of the display panel 120 in a normal driving manner (e.g., the full pixel-row driving manner) so the viewer cannot recognize an image quality difference (or, e.g., a luminance difference) among the first display region FDR, the second display region SDR, and the third display region TDR of the display panel 120. In addition, when the display panel driving circuit 140 drives only the first display region FDR and the third display region TDR of the display panel 120 to display an image, the display panel driving circuit 140 may drive the first display region FDR of the display panel 120 in a full pixel-row driving manner, by which all pixel-rows may perform a display operation in each frame, and may drive the third display region TDR of the display panel 120 in a partial pixel-row driving manner, by which some pixel-rows that are selected differently in each frame may perform a display operation in each frame. For example, when the display panel driving circuit 140 drives only the first display region FDR and the third display region TDR of the display panel 120 to display an image, the display panel driving circuit 140 may cause a blur in a boundary line occurring in the third display region TDR of the display panel 120. The blur in the boundary line may be caused by driving the first display region FDR of the display panel 120, which the viewer may recognize as a main display region, in a normal driving manner (e.g., the full pixel-row driving manner), and by driving the third display region TDR of the display panel 120, which the viewer may not recognize as the main display region, in the partial pixel-row driving manner. For example, the third display region TDR may be a region of the display panel 120 that corresponds to the seam side of the foldable display device 100*a* or a region of the display panel 120 that is adjacent to the housing of the slidable display device 100*b*.

For example, as illustrated in FIG. 2, the display panel driving circuit 140 may determine the first display region FDR, the second display region SDR, and the third display region TDR of the display panel 120 (S110) and may check whether an image is displayed on the second display region SDR of the display panel 120 (S120). For example, when the image is displayed on the second display region SDR of the display panel 120, the display panel driving circuit 140 may determine that the image is displayed on the first display region FDR, the second display region SDR, and the third display region TDR of the display panel 120 and may drive the first display region FDR, the second display region SDR, and the third display region TDR the display panel 120 in the full pixel-row driving manner by which all pixel-rows may perform a display operation in each frame (S130). In other words, when the image is displayed on the first display region FDR, the second display region SDR, and the third display region TDR of the display panel 120, a data applying operation may be performed on all pixel-rows of the first display region FDR, the second display region SDR, and the third display region TDR of the display panel 120 in each frame (e.g., all pixel-rows of the first display region FDR, the second display region SDR, and the third display region TDR of the display panel 120 may perform the display operation in each frame). For example, when the image is not displayed on the second display region SDR of the display panel 120, the display panel driving circuit 140 may determine that the image is displayed only on the first display region FDR and the third display region TDR of the display panel 120, and may drive the first display region FDR of the display panel 120 in the full pixel-row driving manner by which all pixel-rows may perform the display operation in each frame (S140). In addition, the display panel driving circuit 140 may drive the third display, region TDR of the display panel 120 in the partial pixel-row driving manner by which some pixel-rows that are selected differently in each frame may perform the display operation in each frame (S150). In other words, when the image is displayed only on the first display region FOR and the third display region TDR of the display panel 120, the data applying operation may be performed on all pixel-rows of the first display region FDR of the display panel 120 in each frame (e.g., all pixel-rows of the first display region FDR of the display panel 120 may perform the display operation in each frame). In addition, the data applying operation may be performed on only some pixel-rows of the third display region TDR of the display panel 120, which do not overlap between adjacent frames, in each frame (e.g., only some pixel-rows of the third display region TDR of the display panel 120 may perform the display operation in each frame).

As described above, the display device 100 may include the display panel 120 (e.g., the foldable display panel or the slidable display panel) That includes the first display region FDR, the second display region SDR, and the third display region TDR that is disposed between the first display region FDR and the second display region SDR, and the display panel driving circuit 140 that drives the display panel 120, For example, the display device 100 may reduce (or, for example, minimize) a degree that the viewer perceives the boundary line due to the deterioration difference between a display region (e.g., the first display region FDR), of which an operating time is relatively long, in the display panel 120 and another display region (e.g., the second display region SDR), of which an operating time is relatively short, in the display panel 120 by controlling the display panel driving circuit 140 to drive the first display region FDR, the second display region SDR, and the third display region TDR of the display panel 120 in the pixel-row driving manner when the image is displayed on the first display region FDR, the second display region SDR, and the third display region TDR, and by controlling the display panel driving circuit 140 to drive the first display region FDR of the display panel 120 in the full pixel-row driving manner and to drive the third display region TDR of the display panel 120 in the partial pixel-row driving manner when the image is displayed only on the first display region FDR and the third display region TDR of the display panel 120. In addition, when the first display region FDR, the second display region SDR, and the third display region TDR of the display panel 120 are driven in the full pixel-row driving manner, all pixel-rows perform the display operation in each frame. Further, when the third display region TDR is driven in the partial pixel-row driving manner, only some pixel-rows that are selected differently in each frame perform the display operation in each frame. Generally, the deterioration difference between the first display region FDR and the second display region SDR of the display panel 120 may occur as, a display operation that is based on the folding operation (e.g., when the display device 100 is the foldable display device 100*a*) and a display operation that is based on the pulling (or, for example, sliding or rolling) operation e.g., when the display device 100 is the slidable display device 100*b*) is performed. Thus, in a situation where the deterioration difference occurs between the first display region FDR and the second display region SDR of the display panel 120 (e.g., when the image is not displayed on the second display region SDR of the display panel 120 while the image is displayed on the first display region FDR of the display panel 120), the display device 100 may blur the boundary line occurring in the third display region TDR of the display panel 120 by driving the third display region TDR of the display panel 120 that s disposed between the first display region FDR of the display panel 120 and the second display region SDR of the display panel 120 in the partial pixel-row driving manner. As a result, the display device 100 may prevent the viewer or user from recognizing the boundary line when the image is displayed on an entire region (e.g., the first display region FDR, the second display region SDR, and third display region TDR) of the display panel 120, and thus, the display device 100 may provide a high-quality image to the viewer.

Figure 5:
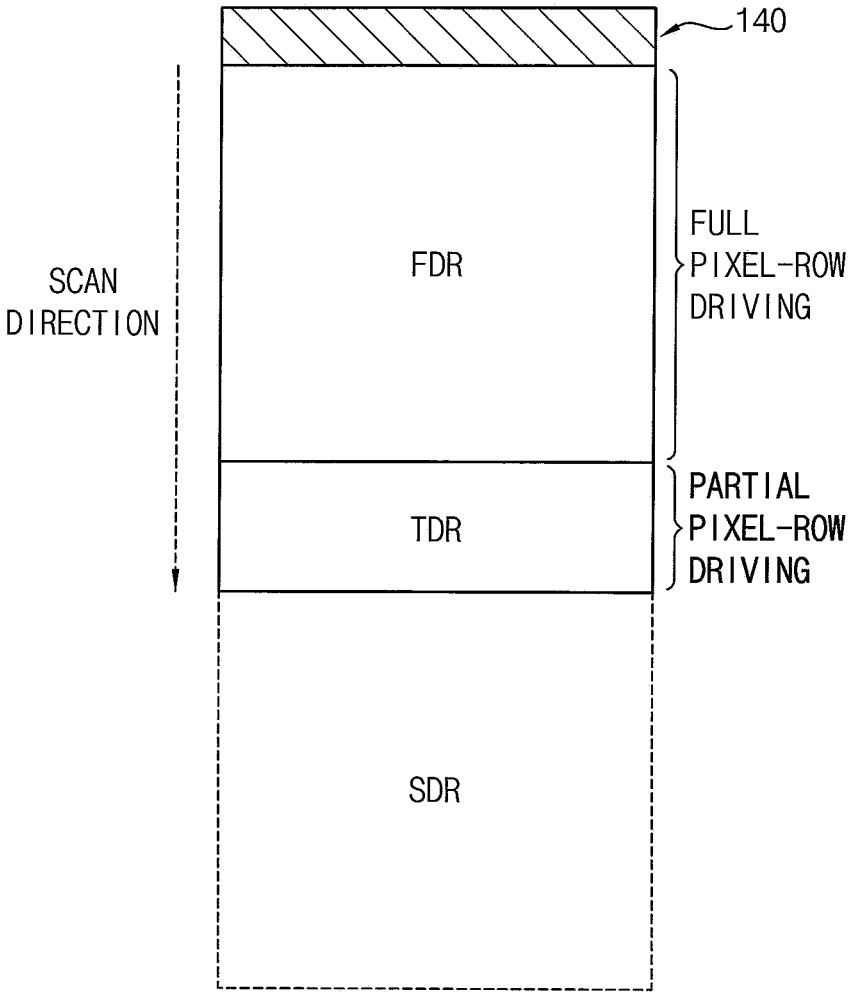
FIG. 5 is a diagram illustrating an example in which a display panel driving circuit included in the display device of FIG. 1 drives a third display region in a partial pixel-row driving manner.
Figure 6A:
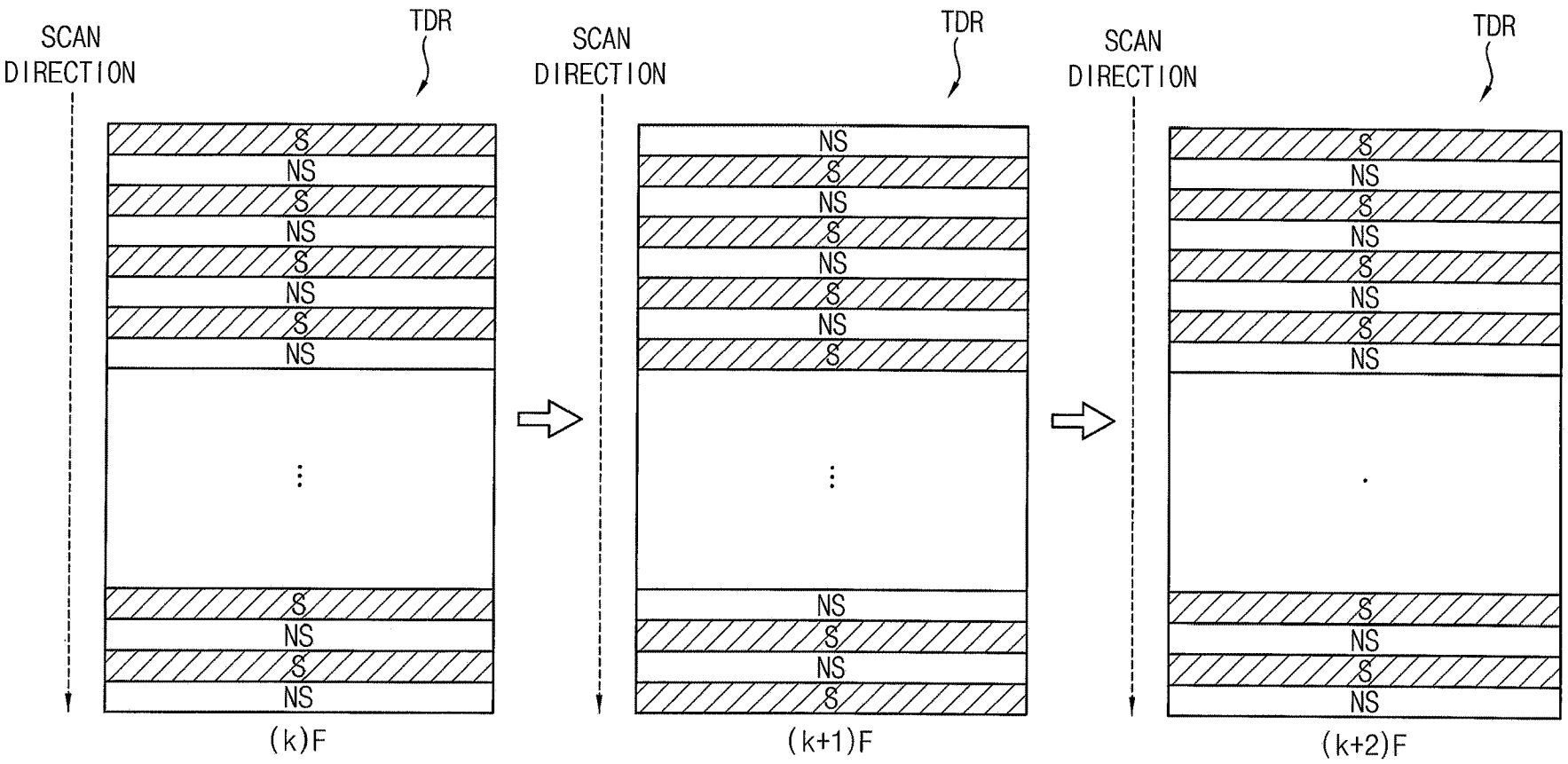
FIG. 6A is a diagram illustrating an example in which is display panel driving circuit included in the display device of FIG. 1 selects selected pixel-rows of a third display region.

FIG. 5 is a diagram illustrating an example in which a display panel driving circuit included in the display device of FIG. 1 drives a third display region in a partial pixel-row driving manner. FIG. 6A is a diagram illustrating an example in which a display panel driving circuit included in the display device of FIG. 1 selects selected pixel-rows of a third display region, and FIG. 6B is a diagram illustrating an example in which a display panel driving circuit included in the display device of FIG. 1 selects selected pixel-rows of a third display region.

Figure 6B:
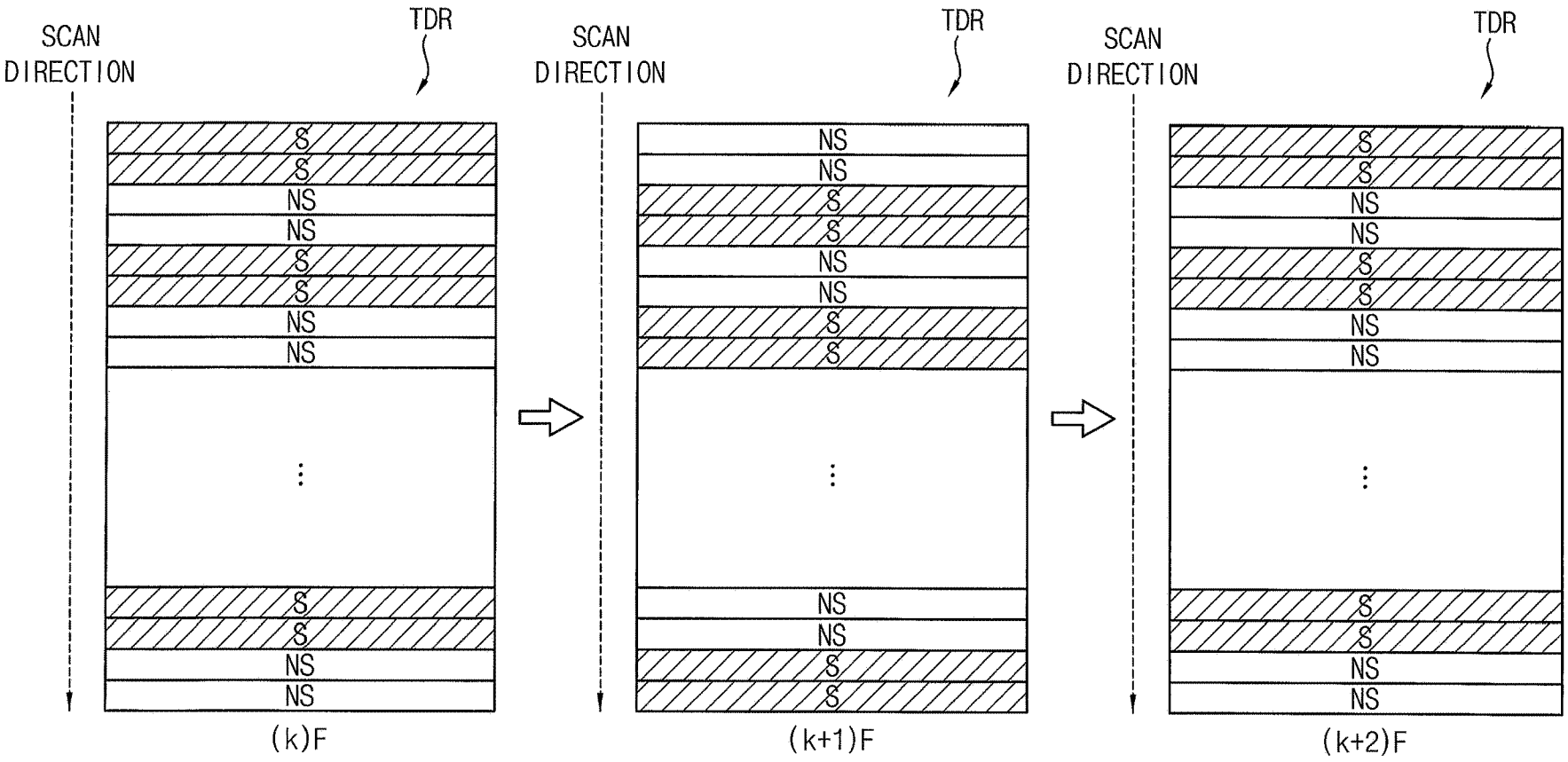
FIG. 6B is a diagram illustrating an example in which a display panel driving circuit included in the display device of FIG. 1 selects selected pixel-rows of a third display region.

Referring to FIGS. 5 to 6B, when the image is displayed only on the first display region FDR and the third display region TDR of the display panel 120, the display panel driving circuit 140 may drive the first display region FDR of the display panel 120 in the full pixel-row driving manner (e.g., indicated by FULL PIXEL-ROW DRIVING) by which all pixel-rows perform the display operation in each frame and may drive the third display region TDR of the display panel 120 in the partial pixel-row driving manner (e.g., indicated by PARTIAL PIXEL-ROW DRIVING) by which only some pixel-rows that are selected differently in each frame perform the display operation in each frame.

The display panel driving circuit 140 may drive an entire region of the third display region TDR of the display panel 120 at the same refresh rate when the display panel driving circuit 140 drives the third display region TDR of the display panel 120 in the partial pixel-row driving manner by which only some pixel-rows that are selected differently in each frame perform the display operation in each frame. For example, the refresh rate of the third display region TDR of the display panel 120 may be 1 when all pixel-rows of the third display region TDR of the display panel 120 perform the display operation. For example, the refresh rate of the third display region TDR of the display panel 120 may be ½ when one pixel-row is selected among two pixel-rows as a selected pixel-row S. For example, the refresh rate of the third display region TDR of the display panel 120 may be ⅓ when one pixel-row is selected among three pixel-rows as the selected pixel-row S. For example the refresh rate of the third display region TDR of the display panel 120 may be ¼ when one pixel-row is selected among four pixel-rows as the selected pixel-row S. For example, the refresh rate of the third display region TDR of the display panel 120 may be ⅔ when two pixel-rows are selected among three pixel-rows as the selected pixel-rows S. For example, the refresh rate of the third display region TDR of the display panel 120 may be ¾ when three pixel-rows are selected among four pixel-rows as the selected pixel-rows S. Since these are examples, the display panel driving circuit 140 may determine the refresh rate of the third display region TDR of the display panel 120 in various ways. In an exemplary embodiment of the present invention, the display panel driving circuit 140 may perform the data applying operation on the selected pixel-rows S of the third display region TDR of the display panel 120 and may perform the charge sharing operation on unselected pixel-rows NS of the third display region TDR of the display panel 120 when the display panel driving circuit 140 drives the third display region TDR of the display panel 120 in the partial pixel-row driving manner. In an exemplary embodiment of the present invention, the display panel driving circuit 140 may perform the data applying operation on the selected pixel-rows S of the third display region TDR of the display panel 120 and may not perform the data applying operation on the unselected pixel-rows NS of the third display region TDR of the display panel 120 when the display panel driving circuit 140 drives the third display region TDR of the display panel 120 in the partial pixel-row driving manner.

In an exemplary embodiment of the present invention, the display panel driving circuit 140 may determine the selected pixel-rows S of the third display region TDR of the display panel 120 not to overlap (or, e.g., not to be selected again) between adjacent frames when the display panel driving circuit 140 drives the third display region TDR of the display panel 120 in the partial pixel-row driving manner by which only some pixel-rows that are selected differently in each frame perform the display operation in each frame. In an exemplary embodiment of the present invention, as illustrated in FIG. 6A, the display panel driving circuit 140 may discretely select the selected pixel-rows S of the third display region TDR of the display panel 120 in nits of one pixel-row. For example, the display panel driving circuit 140 may determine t2m−1)th pixel-rows, where m is an integer greater than or equal to 1, as the selected pixel-rows S in a (k)th frame (k)F, where k is an integer greater than or equal to 1, and may determine (2m)th pixel-rows as the selected pixel-rows S in a (k+1)th frame (k+1)F. In addition, the display, panel driving circuit 140 may determine (2m−1)th pixel-rows as the selected pixel-rows S in a (k+2)th frame (k+2)F. In other words, the selected pixel-rows S of the third display region TDR of the display panel 120 may be selected not to overlap between adjacent frames and may be discretely selected in units of one pixel-row. In an exemplary embodiment of the present invention, as illustrated in FIG. 6B, the display panel driving circuit 140 may discretely select the selected pixel-rows S of the third display region TDR of the display panel 120 in units of at least two pixel-rows. For example, the display panel driving circuit 140 may determine (4m−3)th pixel-rows and (4m−2)th pixel-rows as the selected pixel-rows S in a (k)th frame (k)F, and may determine (4m−1)th pixel-rows and (4m)th pixel-rows as the selected pixel-rows S in a (k+1)th frame k+1)F. In addition, the display panel driving circuit 140 may determine (4m−3)th pixel-rows and (4m−2)th pixel-rows as the selected pixel-rows S in a (k+2)th frame (k+2)F. In other words, the selected pixel-rows S of the third display region TDR of the display panel 120 may be selected not to overlap between adjacent frames and may be discretely selected in units of at least two pixel-rows.

As described above, the display panel driving circuit 140 may reduce (or minimize) a degree that a viewer perceives a boundary line in, the third display region TDR due to a deterioration difference between a display region (e.g., the first display region FDR) of which an operating time is relatively long in the display panel 120 and a display region (e.g., the second display region SDR) of which an operating time is relatively short (e.g., shorter than the operating time of the first display region FDR) in the display panel 120 by driving the first display region FDR of the display panel 120 in the full pixel-row driving manner and by driving the third display region TDR of the display panel 120 in the partial pixel-tow driving manner when an image is displayed only on the first display region FDR and the third display region TDR of the display panel 120. Thus, in a situation where the deterioration difference occurs between the first display region FDR and the second display region SDR of the display panel 120 (e.g., when the image is not displayed on the second display region SDR of the display panel 120 while the image is displayed on the first display region FDR of the display panel 120), the display panel driving circuit 140 may blur a boundary line occurring in the third display region TDR of the display panel 120 by driving the third display region TDR of the display panel 120, which is disposed between the first display region FDR of the display panel 120 and the second display region SDR of the display panel 120, at a refresh rate lower than that of the first display region FDR of the display panel 120 (e.g., in the partial pixel row driving manner). Although it is illustrated in FIGS. 6A and 6B that the refresh rate of the third display region TDR of the display panel 120 is ½, the refresh rate of the third display region TDR of the display panel 120 is not limited thereto. In addition, although it is illustrated in FIGS. 6A and 6B, for convenience of description, that the selected pixel-rows S are determined regularly in one frame, it should be understood that the selected pixel-rows S may be determined irregularly in one frame.

Figure 7:
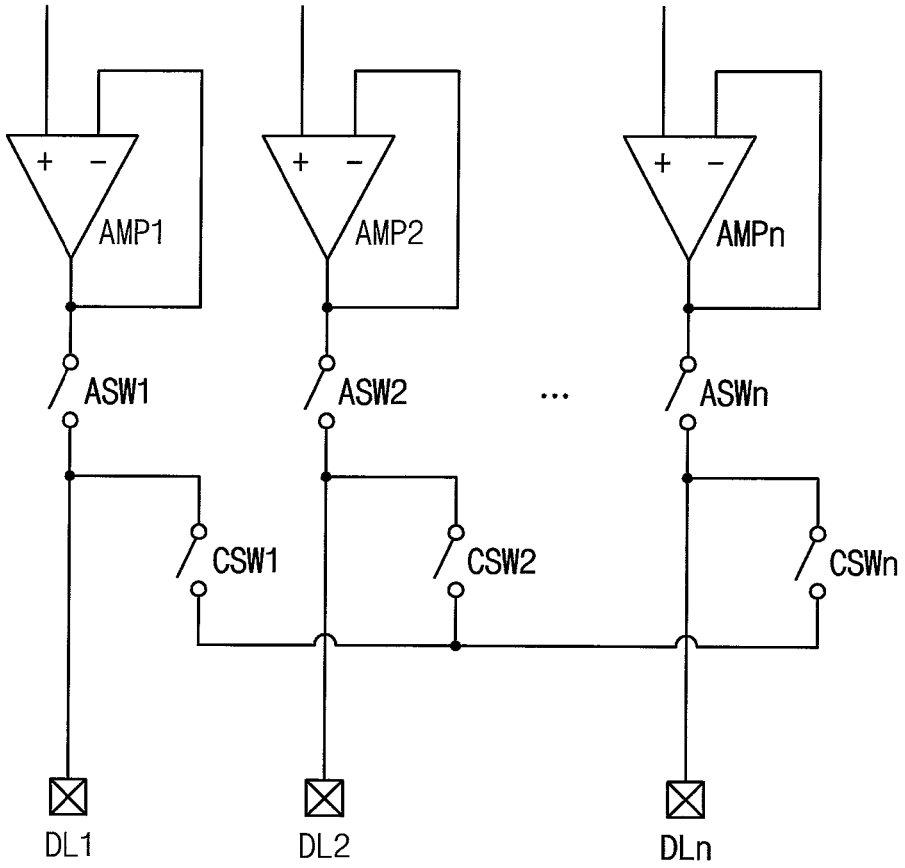
FIG. 7 is a diagram illustrating a display panel driving circuit included in the display device of FIG. 1 performing a data applying operation and a charge sharing operation in a third display region.

FIG. 7 is a diagram illustrating a display panel driving circuit included in the display device of FIG. 1 performing a data applying operation and a charge sharing operation in a third display region.

Referring to FIG. 7, when the display panel driving circuit 140 drives the third display region TDR of the display panel 120 in the partial pixel-row driving manner, by which only some pixel-rows that are selected differently in each frame perform the display operation in each frame, the display panel driving circuit 140 may perform the data applying operation on the selected pixel-rows S of the third display region TDR of the display panel 120 and may perform the charge sharing operation on the unselected pixel-rows NS of the third display region TDR of the display panel 120. For example, when the display panel driving circuit 140 (e.g., the data driver) performs the data applying operation, the display panel driving circuit 140 may turn on first through (n)th data applying switches ASW1 through ASWn, where n is an integer greater than or equal to 2, and may turn off first through (n)th charge sharing switches CSW1 through CSWn. Thus, first through (n)th data signals passing through first through (n)th amplifiers AMP1 through AMPn may be applied to first through (n)th data-lines DL1 through DLn, respectively. In addition, when the display panel driving circuit 140 performs the charge sharing operation, the display panel driving circuit 140 may turn off the first through (n)th data applying switches ASW1 through ASWn and may turn on the first through (n)th charge sharing switches CSW1 through CSWn. Thus, the first through (n)th data signals passing through the first through (n)th amplifiers AMP1 through AMPn may not be applied to the first through (n)th data-lines DL1 through DLn, respectively. However, because charges corresponding to previous data signals are shared among the first through (n)th data-lines DLI through DLn as the first through (n)th charge sharing switches CSW1 through CSWn are turned on, the pixels included in corresponding pixel-row (e.g., the unselected pixel-row NS) may emit light based on voltages corresponding to the shared charges. As a result, as compared to a case in which the pixels included in the unselected pixel-rows NS emit no light, frame-luminance may be increased, and thus effects such as reduced power consumption may be obtained.

For example, referring to FIGS. 6A and 7, the display panel driving circuit 140 may perform the data applying operation on the (2m−1)th pixel-rows (e.g., the selected pixel-rows S) and may perform the charge sharing operation on the (2m)th pixel-rows (e.g., the unselected pixel-rows NS) in the (k)th frame (k)F. For example, the display panel driving circuit 140 may perform the data applying operation on the first pixel-row, which may be the selected pixel-row S (e.g., the first through (n)th data applying switches ASW1 through ASWn may be turned on, and the first through (n)th charge sharing switches CSW1 through CSWn may be turned off), and may perform the charge sharing operation on the second pixel-row, which may be the unselected pixel-row NS (e.g., the first through (n)th data applying switches ASW1 through ASWn may be turned off, and the first through (n)th charge sharing switches CSW1 through CSWn may be turned on). Further, the display panel driving circuit 140 may perform the data applying operation on the, third pixel-row, which may be the selected pixel-row S, and may perform the charge sharing operation on the fourth pixel-row, which may be the unselected pixel-row NS. In addition, the display panel driving circuit 140 may perform the charge sharing operation on the (2m−1)th pixel-rows (e.g., the unselected pixel-rows NS) and may perform the data applying operation on the (2m)th pixel-rows (e.g. the selected pixel-rows S) in the (k+1)th frame (k+1)F. For example, the display panel driving circuit 140 may perform the charge sharing operation an the first pixel-row, which may be the unselected pixel-row NS (e.g., the first through (n)th data applying switches ASW1 through ASWn may be turned off, and the first through (n)th charge sharing switches CSW1 through CSWn may be turned on), and may perform the data applying operation on the second pixel-row, which may be the selected pixel-row S (e.g. the first through (n)th data applying switches ASW1 through ASWn may be turned on, and the first through (n)th charge sharing switches CSW1 through CSWn may be turned off). In addition, the display panel driving circuit 140 may perform the charge sharing operation on the third pixel-row, which may be the unselected pixel-row NS, and may perform the data applying operation on the fourth pixel-row, which may be the selected pixel-row S.

For example, referring to FIGS. 6B and 7, the display panel driving circuit 140 may perform the data applying operation on the (4m−3)th pixel-rows e.g., the selected pixel-rows S) and the (4m−2)th pixel-rows (e.g., the selected pixel-rows S) and may perform the charge sharing operation on the (4m−1)th pixel-rows (e.g., the unselected pixel-rows NS) and the (4m)th pixel-rows (e.g., the unselected pixel-rows NS) in the (k)th frame (k)F, For example, the display panel driving circuit 140 may perform the data applying operation on the first pixel-row, which may be the selected pixel-row S (e.g., the first through (n)th data applying switches ASW1 through ASWn may be turned on, and the first through (n)th charge sharing switches CSW1 through CSWn may be turned off), and may perform the data applying operation on the second pixel-row, which may be the selected pixel-row S. In addition, the display panel driving circuit 140 may perform the charge sharing operation on the third pixel-row, which may be the unselected pixel-row NS (e.g., the first through (n)th data applying switches ASW1 through ASWn may be turned off, and the first through (n)th charge sharing switches CSW1 through CSWn may be turned on), and may perform the charge sharing operation on the fourth pixel-row, which may be the unselected pixel-row NS. In addition, the display panel driving circuit 140 may perform the charge sharing operation on the (4m−1)th pixel-rows (e.g., the unselected pixel-rows NS) and the (4m−2)th pixel-rows (e.g., the unselected pixel-rows NS) and may perform the data applying operation on the (4m−1)th pixel-rows (e.g., the selected pixel-rows S) and the (4m)th pixel-rows (e.g., the selected pixel-rows S) in the (k+1)th frame (k+1)F. For example, the display panel driving circuit 140 may perform the charge sharing operation on the first pixel-row, which may be the unselected pixel-row NS (e.g., the first through (n)th data applying switches ASW1 through ASWn may be turned off, and the first through (n)th charge sharing switches CSW1 through CSWn may be turned on), and may perform the charge sharing operation on the second pixel-row, which may be the unselected pixel-row NS. Further, the display panel driving circuit 140 may perform the data applying operation on the third pixel-row, which may be, the selected pixel-row S (e.g., the first through (n)th data applying switches ASW1 through ASWn may be turned on, and the first through (n)th charge sharing switches CSW1 through CSWn may be turned off), and may perform the data applying operation on the fourth pixel-row, which may be, the selected pixel-row S.

Figure 8:
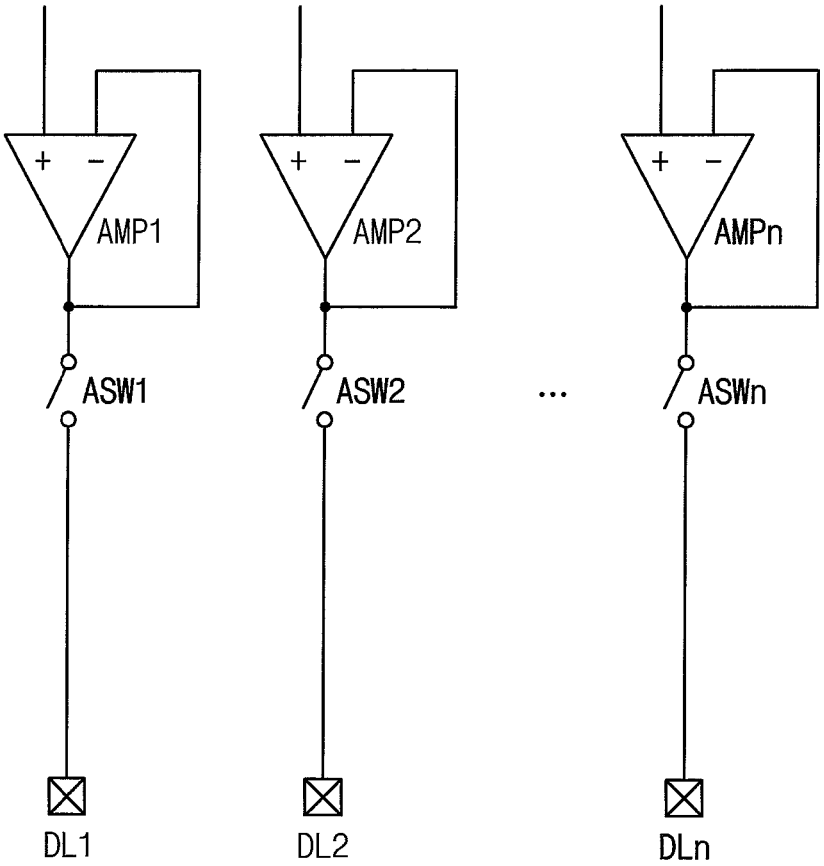
FIG. 8 is a diagram illustrating a display panel driving circuit included in the display device of FIG. 1 performing a data applying operation and a data non-applying operation in a third display region.

FIG. 8 is a diagram illustrating a display panel driving circuit included in the display device of FIG. 1 performing a data applying operation and a data non-applying operation in a third display region.

Referring to FIG. 8, when the display panel driving circuit 140 drives the third display region TDR of the display panel 120 in the partial pixel-row driving manner, by which only some pixel-rows that, are selected differently in each frame perform the display operation in each frame, the display panel driving circuit 140 may perform the data applying operation on the selected pixel-rows S of the third display region TDR of the display panel 120 and may not perform the data applying operation on the unselected pixel-rows NS of the third display region TDR of the display panel 120. For example, when the display panel driving circuit 140 (e.g., the data driver) performs the data applying operation, the display panel driving circuit 140 may turn on first through (n)th data applying switches ASW1 through ASWn. Thus, the first through (n)th data signals passing through the first through (n)th amplifiers AMP1 through AMPn may be applied to the first through (n)th data-lines DL1 through DLn, respectively. In addition, when the display panel driving circuit 140 does not perform the data applying operation the display panel driving circuit 140 may turn off the first through (n)th data applying switches ASW1 through ASWn. Thus, the first through (n)th data signals passing through the first through (n)th amplifiers AMP1 through AMPn may riot be applied to the first through (n)th data-lines DL1 through DLn, respectively.

For example, referring to FIGS. 6A and 8, the display panel driving circuit 140 may perform the data applying operation on the (2m−1)th pixel-rows (e.g., the selected pixel-rows S) and may not perform the data applying operation on the (2m)th pixel-rows (e.g., the unselected pixel-rows NS) in the (k)th frame (k)F. For example, the display panel driving circuit 140 may perform the data applying operation on the first pixel-row, which may be the selected pixel-row S (e.g., the first through (n)th data applying switches ASW1 through ASWn may be turned on), and may not perform the data applying operation on the second pixel-row, which may be the unselected pixel-row NS (e.g., the first through (n)th data applying switches ASW1 through ASWn may be turned off). Further, the display panel driving circuit 140 may perform the data applying operation on the third pixel-row, which may be the selected pixel-row S, and may not perform the data applying operation on the fourth pixel-row, which may be the unselected pixel-row NS. In addition, the display panel driving circuit 140 may not perform the data applying operation on the (2m−1)th pixel-rows (e.g., the unselected pixel-rows NS) and may perform the data applying operation on the (2m)th pixel-rows (e.g., the selected pixel-rows S) the (k+1)th frame (k+1)F. For example, the display panel driving, circuit 140 may not perform the data applying operation on the, first pixel-row, which may be the selected pixel-row NS (e.g., the first through (n)th data applying switches ASW1 through ASWn may be turned off), and may perform the data applying operation on the second pixel-row, which may be the selected pixel-row S the first through (n)th data applying switches ASW1 through ASWn may be turned on), and may not perform the data applying operation on the third pixel-row, which may be the unselected pixel-row S. Further, the display panel driving circuit 140 may perform the data applying operation on the fourth pixel-row, which may be the selected pixel-row S.

For example, referring to FIGS. 6B and 8, the display panel driving circuit 140 may perform the data applying operation on the (4m−3)th pixel-rows (e.g., the selected pixel-rows S) and the (4m−2)th pixel-rows (e.g., the selected pixel-rows S) and may not perform the data applying operation on the (4m−1)th pixel-rows (e.g., the unselected pixel-rows NS) and the (4m)th pixel-rows (e.g., the unselected pixel-rows NS) in the (k)th frame (k)F. For example, the display panel driving circuit 140 may perform the data applying operation on the first pixel-row, which may be the selected pixel-row S (e.g., the first through (n)th data applying switches ASW1 through ASWn may be turned on), and may perform the data applying operation on the second pixel-row, which may be the selected pixel-row S. Further, the display panel driving circuit 140 may not, perform the data applying operation on the third pixel-row, which may be the unselected pixel-row NS (e.g., the first through (n)th data applying switches ASW1 through ASWn may be turned off), and may not perform the data applying operation on the fourth pixel-row, which may be the unselected pixel-row NS. in addition, the display panel driving circuit 140 may not perform the data applying operation on the (4m−3)th pixel-rows (e.g. the unselected pixel-rows NS) and the (4m−2)th pixel-rows (e.g., the unselected pixel-rows NS) and may perform the data, applying operation on the (4m−1)th pixel-rows (e.g., the selected pixel-rows S) and the (4m)th pixel-rows (e.g., the selected pixel-rows 5) in the (k+1)th frame (k+1)F. For example, the display panel driving circuit 140 may not perform the data applying operation on the first pixel-row, which may be the unselected pixel-row NS (e.g., the first through (n)th data applying switches ASW1 through ASWn may be turned oft), and may not perform the data applying operation on the second pixel-row, which may be the unselected pixel-row NS. Further, the display panel driving circuit 140 may perform the data applying operation on the third pixel-row, which may be the selected pixel-row S (e.g., the first through (n)th data applying switches ASW1 through ASWn may be turned on), and may perform the data applying operation on the fourth pixel-row, which may be the selected pixel-row S.

Figure 9:
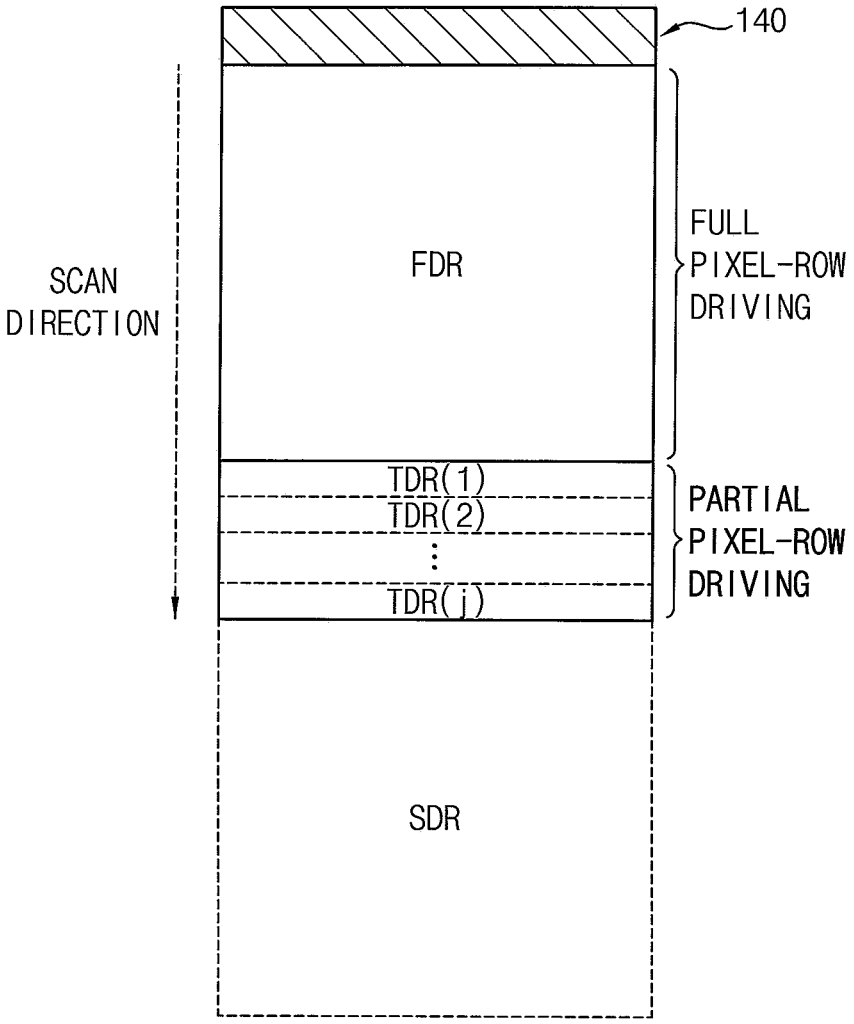
FIG. 9 is a diagram illustrating an example in which a display panel driving circuit included in the display device of FIG. 1 drives a third display region in a partial pixel-row driving manner.

FIG. 9 is a diagram illustrating an example in which a display panel driving circuit included in the display device of FIG. 1 drives a third display region in a partial pixel-row driving manner.

Referring to FIG. 9, when the image is displayed only on the first display region FDR and the third display region TDR of the display panel 120, the display panel driving circuit 140 may drive the first display region FDR of the display panel 120 in the full pixel-row driving manner (e.g., indicated by FULL PIXEL-ROW DRIVING), by which all pixel-rows perform the display operation in each frame, and the display panel driving circuit 140 may drive the third display region TDR of the display panel 120 in the partial pixel-row driving manner (e.g., indicated by PARTIAL PIXEL-ROW DRIVING), by which only some pixel-rows which are selected differently in each frame perform the display operation.

When the display panel driving circuit 140 drives the third display region TDR of the display panel 120 in the partial pixel-row driving manner, the display panel driving circuit 140 may divide the third display region TDR of the display panel 120 into first through (j)th sub-display regions TDR(1) through TDR(j), where j is an integer greater than, or equal to 2, and the display panel driving circuit 140 may drive each of the first through (j)th sub-display regions TDR(1) through TDR(j) at a predetermined refresh rate. In addition, each of the refresh rates of the first through (j)th sub-display regions TDR(1) through TDR(j) are different from each other. Since it is described above that the display panel driving circuit 140 determines the refresh rate of the third display region TDR of the display panel driving circuit 140, duplicated description related thereto will not be repeated. Here, the display panel driving circuit 140 may decrease the refresh rates in a direction from the first sub-display region TDR(1) that is adjacent to the first display region FDR of the display panel 120 to the (j)th sub-display region TDR(j) that is adjacent to the second display region SDR of the display panel 120. For example, when all pixel-rows of the third display region TDR of the display panel 120 perform the display operation, the refresh rate of the third display region TDR the display panel 120 may be 1, the refresh rate of the first sub-display region TDR(1) of the display panel 120 may be ½, the refresh rate of the second sub-display region TDR(2) of the display panel 120 may be ⅓, the refresh rate of the third sub-display region TDR(1) of the display panel 120 may be ¼, and the refresh rate of the (j)th sub-display region TDR(1) of the display panel 120 may be 1/i, where i is an integer greater than or equal to 5. In other words, when the display panel driving circuit 140 drives the third display region TDR of the display panel 120 in the partial pixel-row driving manner, the display panel driving circuit 140 may make the viewer experience the reduced refresh rate less in the third display region TDR that is relatively close to a main display region (e.g., the first display region FDR) of the display panel 120 and may increase an effect of blurring the boundary line in the third display region TDR that is relatively far from the main display region of the display panel 120 by decreasing the refresh rates as the distance from the first sub-display region TDR(1) that is adjacent to the first display region FDR of the display panel 120 increases in a direction toward the second display region SDR. In addition, the refresh rates decrease in a direction from the first sub-display region TDR(1) to the (j)th sub-display region TDR(1) that is adjacent to the second display region SDR of the display panel 120.

Figure 10:
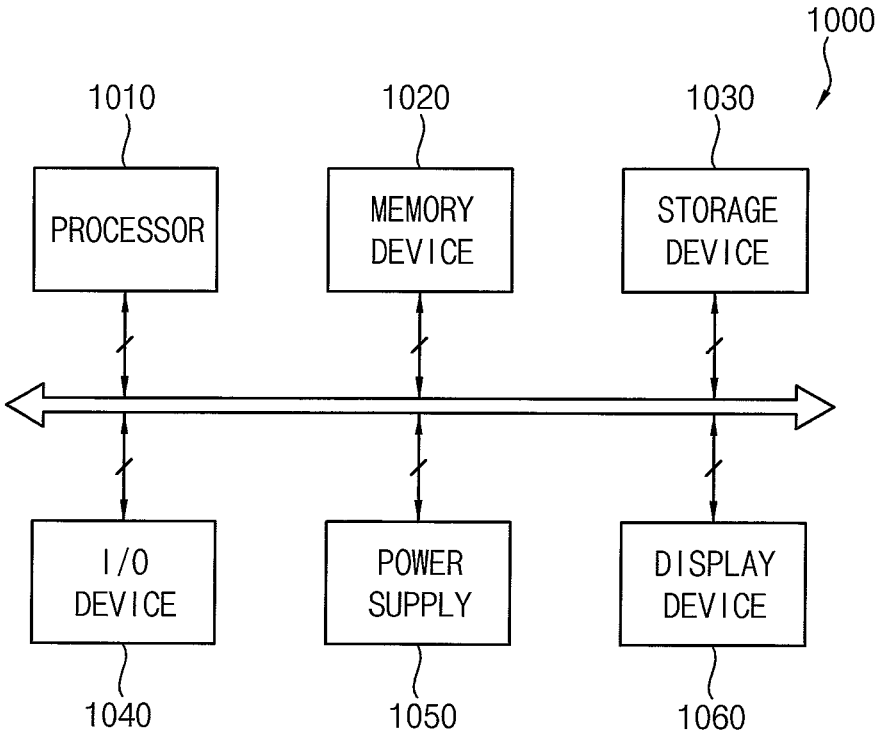
FIG. 10 is a block diagram illustrating an electronic device according to an exemplary embodiment of the present invention.

FIG. 10 is a block diagram illustrating an electronic device according to an exemplary embodiment of the present invention.

Referring to FIG. 10, the electronic device 1000 may include a processor 1010, a memory device 1020, a storage device 1030, an input output (I/O) device 1040, a power supply 1050, and a display device 1060. Here, the display device 1060 may be the display device 100 of FIG. 1. In addition, the electronic device 1000 may further include a plurality of ports for communicating with a video card, a sound card, a memory card, a universal serial bus (USB) device, other electronic devices, etc. In an exemplary embodiment of the present invention, the electronic device 1000 may be implemented as a smart phone, a cellular phone, a video phone, a smart pad, a smart watch, a tablet PC, a car navigation system, a television, a computer monitor, a laptop, a head mounted display (HMD) device, etc.

The processor 1010 may perform various computing functions. The processor 1010 may be a micro processor, a central processing unit (CPU), an application processor (AP), etc. The processor 1010 may be coupled to other components via an address bus, a control bus, a data bus, etc. Further, the processor 1010 may be coupled to an extended bus such as a peripheral component interconnection (PCI) bus. The memory device 1020 may store data for operations of the electronic device 1000. For example, the memory device 1020 may include at least one non-volatile memory device and/or at least one volatile memory device. For example, a non-volatile memory device may be an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and a volatile memory device may be a dynamic random access memory (DRAM) device, a static random access memory (SRAM) device, a mobile DRAM device, etc. The storage device 1010 may include a solid state drive (SSD) device, a bard disk drive (HDD) device, a CD-ROM device, etc. The I/O device 1040 may include an input device, such as a keyboard, a keypad, a mouse device, a touch-pad, a touch-screen, etc, and an output device, such as a printer, a speaker, etc. In an exemplary embodiment of the present invention, the I/O device 1040 may include the display device 1060. The power supply 1050 may provide power for operations of the electronic device 1000.

The display device 1060 may be coupled to other components via the buses or other communication links. In an exemplary embodiment of the present invention, the display device 1060 may be an organic light-emitting display device. However, the display device 1060 is not limited thereto, The display device 1060 may provide a high-quality image to a viewer (or, for example, user) by reducing a degree that the viewer perceives a boundary line due to a deterioration difference between a display region (e.g., a first display region), of which an operating time is relatively long, and a display region (e.g., a second display region), of which an operating time is relatively short, where the boundary line is displayed on a third display region that is disposed between the first display region and the second display region. To this end, the display device 1060 may include a display panel that includes the first display region, the second display region, and the third display region and a display panel driving circuit that drives the display panel.

Here, when an image is displayed on the first display region, the second display region, and the third display region of the display panel, the display panel driving circuit may drive the first display region, the second display region, and the third display region of the display panel in a full pixel-row driving manner by which all pixel-rows perform a display operation in each frame. In addition, when an image is displayed only on the first display region and the third display region of the display panel, the display panel driving circuit may drive the first display region of the display panel in the full pixel-row driving manner, by which all pixel-rows perform the display operation in each frame, and may drive the third display region of the display panel in the partial pixel-row driving manner, by which only some pixel-rows that are selected differently in each frame perform the display operation. Since the display device 1060 is described above, duplicated description related thereto will not be repeated.

The present invention may be applied to a display device and an electronic device including the display device. For example, the present invention may be applied to a smart phone, a cellular phone, a video phone, a smart pad, smart watch, a tablet PC, a car navigation system, a television, a computer monitor, a laptop, a head mounted display device, an MP3 player, etc.

While the present invention has been described with reference to exemplary embodiments thereof, it will be understood by those of ordinary skill in the art that various changes in form and details may be made thereto without departing from the spirit and scope of the present invention.

What is claimed is:

1. A display device comprising:

a display panel including a first display region, a second display region, and a third display region disposed between the first display, region and the second display region; and a display panel driving circuit configured to drive the display panel, wherein the display panel driving circuit drives the first display region, the second display region, and the third display region in a full pixel-row driving manner when an image is displayed on the first display region, the second display region, and the third display region, wherein in the full pixel-row driving manner, all pixel-rows perform a display operation in each frame, and wherein the display panel driving circuit drives the first display region in the full pixel-row driving manner and drives the third display region in a partial pixel-row driving manner when the image is displayed only on the first display region and the third display region, wherein in the partial pixel-row driving manner, some pixel-rows that are selected differently in each frame perform the display operation.

2. The display device of claim 1, wherein the display device is a foldable display device, wherein the first display region is a region of the display panel that corresponds to a front side of the display device when the display panel is folded, wherein the second display region is a region of the display panel that corresponds to a back side of the display device when the display panel is folded, and wherein the third display region connects the first display region to the second display region.

3. The display device of claim 2, wherein the display panel driving circuit displays an image only on the first display region and the third display region when the display panel is folded.

4. The display device of claim 1, wherein the display device is a reliable display device, wherein the first display region is a region of the display panel that is pulled out from a housing and spaced apart from the housing by at least a reference distance, wherein the second display region is a region of the display panel that is disposed in the housing, and wherein the third display region is a region of the display panel that is pulled out from the housing and spaced apart from the housing by a distance less than the reference distance.

5. The display device of claim 4, wherein the display panel driving circuit displays an image only on the first display region and the third display region.

6. The display device of claim 5, wherein an area of the third display region is based on the reference distance.

7. The display device of claim 1, wherein the display panel driving circuit performs a data applying operation on selected pixel-rows of the third display region and performs a charge sharing operation on unselected pixel-rows of the third display region when the display panel driving circuit drives the third display region in the partial pixel-row driving manner.

8. The display device of claim 7, wherein adjacent frames have different selected pixel-rows of the third display region.

9. The display device of claim 8, wherein the selected pixel-rows of the third display region are discretely selected in units of one pixel-row.

10. The display device of claim 8, wherein the selected pixel-rows of the third display region are discretely selected in units of at least two pixel-rows.

11. The display device of claim 7, wherein the display panel driving circuit drives an entire region of the third display region at the same refresh rate when the display panel driving circuit drives the third display region in the partial pixel-row driving manner.

12. The display device of claim 7, wherein the display panel driving circuit divides the third display region into first through (j)th sub-display regions, where j is an integer greater than or equal to 2, and drives the first through (j)th sub-display regions at respective refresh rates drat are different from each other when the display panel driving circuit drives the third display region in the partial pixel-row driving manner.

13. The display device of claim 12, wherein the display panel driving circuit decreases the refresh rates, of the third display region, in a direction from the first sub-display region that is adjacent to the first display region to the (j)th sub-display region that is adjacent to the second display region.

14. The display device of claim 1, wherein the display panel driving circuit performs a data applying operation on selected pixel-rows of the third display region and does not perform the data applying operation on unselected pixel-rows of the third display region when the display panel driving circuit drives the third display region in the partial pixel-row driving manner.

15. The display device of claim 14, wherein adjacent frames have different selected pixel-rows of the third display region.

16. The display device of claim 15, wherein the selected pixel-rows of the third display region are discretely selected in units of one pixel-row.

17. The display device of claim 15, wherein the selected pixel-rows of the third display region are discretely selected in units of at least two pixel-rows.

18. The display device of claim 14, wherein the display panel driving circuit drives an entire region of the third display region at the same refresh rate when the display panel driving circuit drives the third display region in the partial pixel-row driving manner.

19. The display device of claim 14, wherein the display panel driving circuit divides the third display region into first through (j)th sub-display regions, where j is an integer greater than or equal to 2, and drives the first through (j)th sub-display regions at respective refresh rates that are different from each other when the display panel driving circuit drives the third display region in the partial pixel-row driving manner.

20. The display device of claim 19, wherein the display panel driving circuit decreases the refresh rates, of the third display region, in a direction from the first sub-display region that is adjacent to the first display region to the (j)th sub-display region that is adjacent to the second display region.

* * * * *